US012616289B1

(12) United States Patent
Zheng et al.

(10) Patent No.: US 12,616,289 B1
(45) Date of Patent: May 5, 2026

(54) COSMETIC PACKAGE WITH DUAL DISPENSING OF A FLUID PRODUCT

(71) Applicant: APR Beauty Group Inc., Toronto (CA)

(72) Inventors: Min-Yan Zheng, Richmond Hill (CA); Feng-Ying Fu, Markham (CA)

(73) Assignee: APR Beauty Group Inc., Richmond Hill (CA)

( * ) Notice: Subject to any disclaimer, the term of this patent is extended or adjusted under 35 U.S.C. 154(b) by 0 days.

(21) Appl. No.: 19/048,927

(22) Filed: Feb. 9, 2025

(51) Int. Cl.
*A45D 34/04* (2006.01)
*A45D 40/26* (2006.01)

(52) U.S. Cl.
CPC ..... *A45D 34/045* (2013.01); *A45D 34/043* (2013.01); *A45D 40/264* (2013.01); *A45D 40/265* (2013.01); *A45D 2200/056* (2013.01)

(58) Field of Classification Search
CPC .... A45D 34/00; A45D 34/042; A45D 34/043; A45D 34/045; A45D 34/046; A45D 34/06; A45D 40/00; A45D 40/18; A45D 40/20; A45D 40/264; A45D 40/265; A45D 40/267
USPC ..... 401/18, 188 R, 195, 207, 27, 38, 118; 222/189.1, 382; 604/1, 290
See application file for complete search history.

(56) References Cited

U.S. PATENT DOCUMENTS 8,961,050 B2 * 2/2015 Chesson ..... A61M 35/006 401/38
9,730,502 B2 * 8/2017 Naura ..... A45D 40/265
2011/0092868 A1 * 4/2011 Chesson ..... B05B 15/40 602/41
2013/0294809 A1 * 11/2013 Eggers ..... B05B 11/0035 401/6
2015/0282594 A1 * 10/2015 Lim ..... A45D 34/04 401/138
2016/0022013 A1 * 1/2016 Naura ..... A45D 40/265 401/126
2018/0279740 A1 * 10/2018 Kukreja ..... A45D 34/045
2019/0008260 A1 * 1/2019 Wilson ..... A46B 3/18
2019/0021470 A1 1/2019 Kim
2019/0082810 A1 * 3/2019 Roh ..... A45D 34/045
2019/0223577 A1 * 7/2019 Villarreal ..... A45D 40/0075
2020/0102138 A1 * 4/2020 Eng ..... B05B 11/1081
2021/0085056 A1 * 3/2021 Kingswell ..... A45D 40/265
2021/0298450 A1 * 9/2021 Zheng ..... A45D 33/02
2022/0202163 A1 * 6/2022 Zheng ..... A45D 34/042
(Continued)

*Primary Examiner* — Rachel R Steitz
*Assistant Examiner* — Karim Asqiriba
(74) *Attorney, Agent, or Firm* — Jason L DeFrancesco

(57) ABSTRACT

A cosmetic package for dual dispensing of a fluid product. The cosmetic package includes a container body for storing the product, a pumping member with a product suction tube for transferring the product, and a pump support body for supporting the pumping member. A button and dispensing member, located at an upper end of the pumping member, discharges the product through a discharge hole, while an applicator, attached to the lower end of the suction tube to enable direct application. The applicator includes an applying portion with a feeder groove on an outer surface thereof and connects to the product suction tube via a shank portion. When the button and dispensing member is actuated, the product is transferred and dispense through the button and dispensing member.

14 Claims, 10 Drawing Sheets

(56) References Cited

U.S. PATENT DOCUMENTS

| | | | | |
|---|---|---|---|---|
| 2023/0218062 | A1* | 7/2023 | Bourguignat | A45D 34/04<br>401/118 |
| 2023/0255339 | A1* | 8/2023 | Zheng | A45D 34/00<br>401/126 |
| 2023/0276921 | A1* | 9/2023 | Zheng | A45D 34/045<br>132/317 |
| 2024/0016280 | A1* | 1/2024 | Lee | A45D 34/046 |
| 2025/0204674 | A1* | 6/2025 | Hudson | A45D 40/265 |

* cited by examiner

COSMETIC PACKAGE WITH DUAL DISPENSING OF A FLUID PRODUCT

BACKGROUND

Field

The present disclosure relates to a cosmetic package for discharging a fluid product. More specifically, the present disclosure relates to a cosmetic package having a container for storing a cosmetic product, wherein the cosmetic package includes a pump as well as a dip-in applicator for discharging the cosmetic product.

Description of the Related Art

Cosmetic products, such as liquid foundations, lotions, and serums, are commonly packaged in containers designed for both storage and ease of application. These containers often include a dispensing mechanism to ensure controlled and hygienic access to the product. Among the most widely used mechanisms are pumps and dip-in applicators.

Pumps are favored for their ability to dispense a measured amount of product while maintaining the integrity of the remaining product by limiting air exposure. This feature is particularly important for cosmetic formulations that are sensitive to contamination or oxidation. However, pump systems often lack the precision required for certain applications, such as spot treatment or intricate makeup techniques.

Dip-in applicators, on the other hand, provide a more tactile and precise application experience. Applicators such as doe-foot wands, brushes, or spatulas allow users to apply the product directly to specific areas of the skin. Despite their precision, dip-in applicators require the user to open the container, exposing the product to air and potential contaminants, which may compromise product longevity and hygiene.

Efforts have been made to combine the benefits of pumps and dip-in applicators in a single package. However, existing solutions often suffer from design inefficiencies, such as complexity in manufacturing, or difficulty in transitioning between the two dispensing modes. This limits their practicality and acceptance in the market.

For example, US20190021470A1 discloses a cosmetic container with double discharge functionality. The container includes a pumping member with a suction tube that can be detached from the container body. An applicator, located at the lower end of the suction tube, allows the contents to be dispensed through either the pumping mechanism or direct withdrawal via the applicator by detaching the pump support body.

Despite such advancements, there remains a need for an improved cosmetic improved cosmetic package that incorporates both a pump and a dip-in applicator, allowing users to choose between dispensing and direct application modes without compromising product integrity, convenience, or precision.

SUMMARY

It is an object of the present disclosure to provide a cosmetic package is configured to contain and dispense a fluid product.

It is an object of the present disclosure to provide a cosmetic package that that provides both a pump and a dip-in applicator for discharging and applying a fluid product.

A cosmetic package, in an exemplary first embodiment of the present disclosure, comprises a container body, a pumping member, a pump support body, a button and dispensing member, an applicator, and an over cap. The container body is designed to store liquid products such as foundation or cream and includes a wiper coupled into its neck section. The pump support structure is detachably attached to the container body's neck and provides support for the pumping member. An upper portion of the pumping member connects to the button and dispensing member, enabling product discharge. A product suction tube is connected to the lower portion of the pumping member, allowing the liquid product to be drawn from the container body into the pump member. The lower end of the suction tube is affixed to the applicator, facilitating precise product application. The cosmetic package allows product to be discharged directly using the button and dispensing member, or to be applied using the applicator after detaching the pump support body from the container's body.

According to an aspect of the present disclosure, the wiper is designed to closely contact the outer surface of the product suction tube, effectively wiping off any remaining product when the tube is withdrawn from the container body. The hollow design of the wiper allows for smooth insertion and removal of the product suction tube.

According to another aspect of the present disclosure, the pumping member is attached to the upper portion of the container body and is designed to discharge the product stored inside. The pumping member includes a pump housing, which includes a product inflow hole at its lower end and a check valve that regulates the opening and closing of the inflow hole. A stem is connected on one side to the button and dispensing member and extends into the pump housing on the other side, moving up and down with the motion of the button and dispensing member. Below the stem, a piston rod is attached, and a piston ring encases the lower portion of the piston rod, allowing it to move along the inner surface of the pump housing. Additionally, a spring surrounds the stem, providing upward elastic force to enable the button and dispensing member to operate repeatedly, facilitating efficient dispensing of the container body's product.

According to yet another aspect of the present disclosure, the product suction tube is attached to a lower end of the pump housing, which is located at the bottom part of the pumping member. The product suction tube serves as a product passageway, allowing the product stored in the container body to flow into the pump housing whenever the pumping member is in operation.

According to yet another aspect of the present disclosure, the product suction tube can be integrally formed at the lower end of the pump housing or can be manufactured separately from the pump housing and coupled to the pump housing.

According to yet another aspect of the present disclosure, the pump support body is connected to and supports the pumping member. The pump support body includes a coupling part with an internal screw thread, which allows it to be securely attached to or detached from the threaded neck portion of the container body. This screw coupling ensures easy assembly and disassembly of the pump support body with the container body. The pump support body can be unscrewed from the container body and detached together with the pumping member. The cosmetic package, thus, allows the product stored in the container body to be applied using the applicator, which is connected to the lower part of the product suction tube. This occurs when the product suction tube, forming the lower section of the pumping member, is withdrawn from the container body.

According to yet another aspect of the present disclosure, the button and dispensing member, attached to the upper part of the pumping member, transmits the pressure applied by the user to the pumping member, triggering its pumping action. The button and dispensing member has a product discharge hole on one side, allowing the product, moved upward by the pumping action, to be dispensed externally.

According to yet another aspect of the present disclosure, the applicator is attached to the lower end of the product suction tube and is designed to extract the product from the container body for application to the user's skin. After the pump support body is detached from the container body, the applicator when immersed back into the product stored in the container body, the product is coated to the outer surface of the applicator to be easily applied to the skin. The applicator extends along a central longitudinal axis, and includes an applying portion at a distal portion thereof and a shank portion at a proximal portion thereof. For a direct application, the product is applied to the skin of a user using applying portion of the applicator. The shank portion is received within hollow interior of the product suction tube. The shank portion includes at least one connecting feature for coupling to the product suction tube. Particularly, the shank portion includes a protrusion as the connecting feature that snap fits into a groove formed on an inner surface of the product suction pipe.

Furthermore, the applicator includes a feeder groove that extends from adjacent a distal end of the applying portion to a proximal end of the shank portion. The feeder groove has a lower portion formed on an outer surface of the applying portion and an upper portion formed on the shank portion. The feeder groove forms an S-shaped product passageway defined by the lower portion thereof on the outer surface of the applying portion and a straight passage defined by the upper portion of the feeder groove on the shank portion. A width of the feeder groove increases gradually from a distal end thereof towards the proximal end of the applying portion and maintains a constant width from the proximal end of the applying portion to the proximal end of the shank portion. In this particular embodiment, the feeder groove has a maximum width at the proximal end of the applying portion. When the applicator is received at the distal end of the product suction tube, a feeder gap is formed between an inner surface of the product suction tube and an outer surface of the shank portion where the feeder groove exists. The feeder gap defines a product delivery passageway. When the pumping member performs pumping operation, the product stored in the container body can be moved to a product discharge hole through the feeder groove and the product suction tube.

The feeder groove facilitates the smooth transfer of the fluid product into the product suction tube while also serving as a secondary reservoir for the applicator. The feeder groove enhances the bulk loading capacity, ensuring that when the pump support member is disengaged, the applying portion of the applicator retains sufficient fluid product for effective application, thereby eliminating the need for repeated dipping.

According to yet another aspect of the present disclosure, the applying portion of the applicator has a rounded shape with a convex outer surface that narrows toward the distal end, terminating in a narrow-rounded tip. Specifically, the applying portion has an asymmetric oval shape, having a flat proximal end. Additionally, the tip is positioned on the central longitudinal axis of the applicator.

According to yet another aspect of the present disclosure, the applying portion has four faces, namely, a front face, a back face, a left side face, and a right-side face. The back face and the front face are opposing faces, similarly, the left side face and the right-side face are opposing faces. The upper portion of the feeder groove extends axially mainly on the front face of the applying portion. A distal end of the feeder groove aligning with the central longitudinal axis on the front face. Moving toward the proximal end of the applying portion, the feeder groove initially curves away from the central longitudinal axis toward the right-side face, then bends back across the central longitudinal axis toward the left side face, and ultimately terminates at the proximal end of the applying portion.

According to yet another aspect of the present disclosure, the left side face and the right-side face of the applying portion are both predominantly convexly curved along the central longitudinal axis as well as along axes orthogonal to the central longitudinal axis. However, the convex profiles, along the central longitudinal axis, of the left side face and the right-side face are distinct from each other. When viewed from the front face of the applicator, the right-side face exhibits a continuous convex curve extending from the proximal end to the distal end of the applying portion. In contrast, the left side face includes a prominent convex curve extending from the proximal end of the applying portion to a location near the distal portion of the applying portion, where it transitions into a minor concave curve at the distal end. The differing convex profiles, along the central longitudinal axis, of the left side face and the right-side face contribute to a mango-shaped appearance of the applying portion when viewed from either the back face or the front face of the applicator.

According to yet another aspect of the present disclosure, the pump support body comprises two components assembled together to operate as a single unit. These components include an outer sleeve and an inner sleeve enclosed by the outer sleeve. The outer sleeve is characterized by a cylindrical sidewall and an inner flange extending radially inward and orthogonally from an upper peripheral edge of the cylindrical sidewall, thereby defining an upper opening. The cylindrical sidewall of the outer sleeve is open at its bottom end.

According to yet another aspect of the present disclosure, an inner surface of the cylindrical sidewall of the outer sleeve is provided with multiple axial projections that are spaced uniformly around the inner circumference. Additionally, the inner surface of the cylindrical sidewall includes an annular groove located at a lower portion of the sidewall, positioned adjacent to the lower ends of the axial projections.

The inner sleeve has a cylindrical sidewall with open top and bottom ends. An inner flange is formed extending radially inward and perpendicularly from the inner surface of the cylindrical sidewall, defining a central opening within the hollow interior of the cylindrical sidewall. Positioned below the inner flange, threads are provided on the inner surface of the cylindrical sidewall. These threads are designed to engage with corresponding threads on the neck portion of the container body, thereby securing the pump support body to the container body. Additionally, a protrusion is formed on the outer surface of the cylindrical sidewall of the inner cap. This protrusion is configured to be received within the annular groove formed on the lower portion of the cylindrical sidewall of the outer sleeve. This arrangement ensures that the inner cap and the outer sleeve are securely coupled, thereby forming the unified pump support body.

Furthermore, the inner sleeve comprises a plurality of axial ribs uniformly spaced circumferentially on the outer surface of its cylindrical sidewall thereof. The gaps between adjacent axial ribs of the plurality of axial ribs are configured to receive the multiple axial projections located on the inner surface of the outer sleeve. This interlocking arrangement ensures that the inner sleeve and the outer sleeve are rotationally fixed relative to each other, preventing any unintended relative movement.

According to yet another aspect of the present disclosure, the over cap is designed to be detachably coupled, enclosing the button and dispensing member and the pump support body. The over cap prevents accidental operation of the button and dispensing member while also blocking foreign substances from entering the product discharge hole. Once the over cap is removed from the pump support body, the button and dispensing member can be operated to dispense the product through the product discharge hole. The over cap comprises two interconnected parts, an outer cap and an inner cap, which together function as a single unit. The outer cap has a cylindrical structure with a top wall and a sidewall extending downwardly from a peripheral edge of the top wall.

The inner cap includes a double-sidewall design and includes a top wall and a first cylindrical sidewall that extends downwardly from a peripheral edge of the top wall. The inner cap includes a secondary sidewall that is radially outwardly from the first cylindrical sidewall and connected to each other at their lower edges through an annular bottom wall. A circumferential gap exists between the secondary sidewall and the first cylindrical sidewall. The circumferential gap provides flexibility to the structure of the inner cap.

Additionally, the inner surface of the first cylindrical sidewall includes at least three uniformly spaced axial protrusions, which extend from the lower edge of the top wall along the inner surface of the first cylindrical sidewall. When the over cap is positioned over the pump support body, the at least three uniformly spaced axial protrusions ensure a secure and tight engagement between the over cap and the pump support body. This configuration of the over cap contributes to a clean and aesthetically pleasing appearance of the cosmetic package when the over cap is removed, as no visible coupling features are present on the pump support body, the container body, or the button and dispensing member.

According to yet another aspect of the present disclosure, the sidewall of the outer cap includes a groove on its inner surface. An outer surface of the lower portion of the first cylindrical sidewall has a protrusion that fits into the groove of the outer cap, thereby securely coupling the outer cap and the inner cap together.

When the over cap is removed from the pump support body, pressing the button and dispensing member activates the pumping member to discharge the product for use. The product stored in the container body are drawn into the product suction tube through the feeder gap, that exists between the inner surface of the suction pipe and an outer surface of the shank portion, and transported upward. Once the product reaches the pump housing via the product suction tube, they pass through the piston rod and the stem before being dispensed through the product discharge hole, making them ready for application to the skin.

To apply the product using the applicator, the pump support body is unscrewed from the container body, allowing the pump support body to be detached from the container body.

When the pump support body is detached from the container body, the pumping member, which is attached to the pump support body, will also be removed. Consequently, the product suction tube, the pumping member, and the applicator will be withdrawn from the container body. This allows the product on the outer surface of the applicator, which is attached to the lower end of the product suction tube, to be applied directly onto the skin. An additional quantity of the product is held within the feeder groove, eliminating the need for repeated dipping of the applicator into the container body and supplying a sufficient amount of product for effective application.

Essentially, the present disclosure provides the option to either dispense the product through the button and dispensing member using the pumping mechanism or apply the product directly onto the user's skin with the applicator, without the need for pumping. This flexibility caters to user preferences and enhances overall convenience.

A cosmetic package according to a second embodiment of the present disclosure, like the first embodiment, includes a container body, a pumping member, a pump support body, the product suction tube, a button and dispensing member, an applicator, and an over cap. However, in the second embodiment, the structures of the button and dispensing member, the pump support body, the over cap differs slightly from the button and dispensing member, the pump support body, the over cap of the first embodiment.

The button and dispensing member of the second embodiment includes an integrated applicator. The applicator includes an applicator face through which the product is dispensed via a product discharge hole. The applicator face has a larger surface area which enables direct application of the product onto the skin. This eliminates the need to collect the liquid for indirect application by hand, thereby reducing the risk of contamination and ensuring a more hygienic application process. The applicator is positioned offset from the central longitudinal axis of both the cosmetic package and the button and dispensing member. The design of the applicator comprises a neck portion that transitions smoothly into an applicator head, which end in the applicator face at its upper end. The applicator face is shaped as an oblique, drop-shaped surface, which offers a broad yet precise area for applying the product. This offset configuration of the applicator ensures enhanced ergonomics, allowing for better control and precision during application, particularly in hard-to-reach areas or for achieving defined coverage. The button and dispensing member comprises a lower cylindrical button portion, which includes a horizontal pressing surface positioned on its upper section, located adjacent to the applicator.

In contrast to the first embodiment, the over cap of the second embodiment is attached to the outer surface of the upper portion of the pump support body, leaving parts of the pump support body exposed in the closed and covered state of the cosmetic package, unlike the full coverage seen in the first embodiment. Additionally, the outer surface of the upper portion of the pump support body includes a series of bumps designed to engage with an inner groove located on the inner surface of the sidewall of the over cap, thereby enabling a detachable snap-fit connection between the over cap and the pump support body.

In addition, the over cap of the second embodiment is a single-piece component, unlike the first embodiment, which has a two-piece configuration comprising an inner cap and an outer cap. The over cap consists of a cylindrical structure with a top wall and a sidewall extending downwardly from the peripheral edge of the top wall.

In the second embodiment, the pump support body is a single-piece structure, differing from the two-piece configuration of an inner sleeve and an outer sleeve seen in the first embodiment. The pump support body comprises a cylindrical sidewall with open top and bottom ends. An inner flange projects radially inward and perpendicularly from the inner surface of the cylindrical sidewall, forming a central opening within its hollow interior. Below the inner flange, the inner surface of the cylindrical sidewall is equipped with threads, which are designed to engage with complementary threads on the neck of the container body, ensuring a secure and detachable connection. Additionally, the upper portion of the sidewall, above the inner flange, steps inward, creating a horizontal step where the bottom edge of the over cap rests, aligning seamlessly with the outer surface of the lower portion of the pump support body and ensuring a flush fit with the pump support body.

To dispense the product using button and dispensing member, the user first needs to remove the over cap, thereby exposing the button and dispensing member. Dispensing is initiated by pressing the horizontal pressing surface located on the upper part of the button and dispensing member. Upon pressing, the button and dispensing member moves downward, activating the pumping member, which causes the cosmetic product to be dispensed directly onto the applicator face of the applicator. The applicator face is then used to apply the product directly onto the skin, eliminating the need to use hands or any separate tool, thereby avoiding contamination or waste.

If the user intends to utilize the applicator for dispensing and application, the removal of the over cap is not necessary. Instead, the user must unthread the pump support body from the container body. Upon detachment of the pump support body, the suction tube and the applicator are simultaneously removed and exposed, making them ready for product application. During this process, the button and dispensing member remains securely attached to the upper portion of the pump support body and is covered by the over cap, thereby ensuring its cleanliness and protection.

According to an aspect of the present disclosure, the applying portion, of the applicator, may be flocked.

It will be understood that the foregoing is only illustrative of the principles of the disclosure and that various modifications can be made by those skilled in the art without departing from the scope and spirit of the disclosure. For example, the shapes and/or sizes of various components can be different from the shapes and sizes are shown herein. As another example, the materials used for various components can be different from those mentioned specifically herein.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
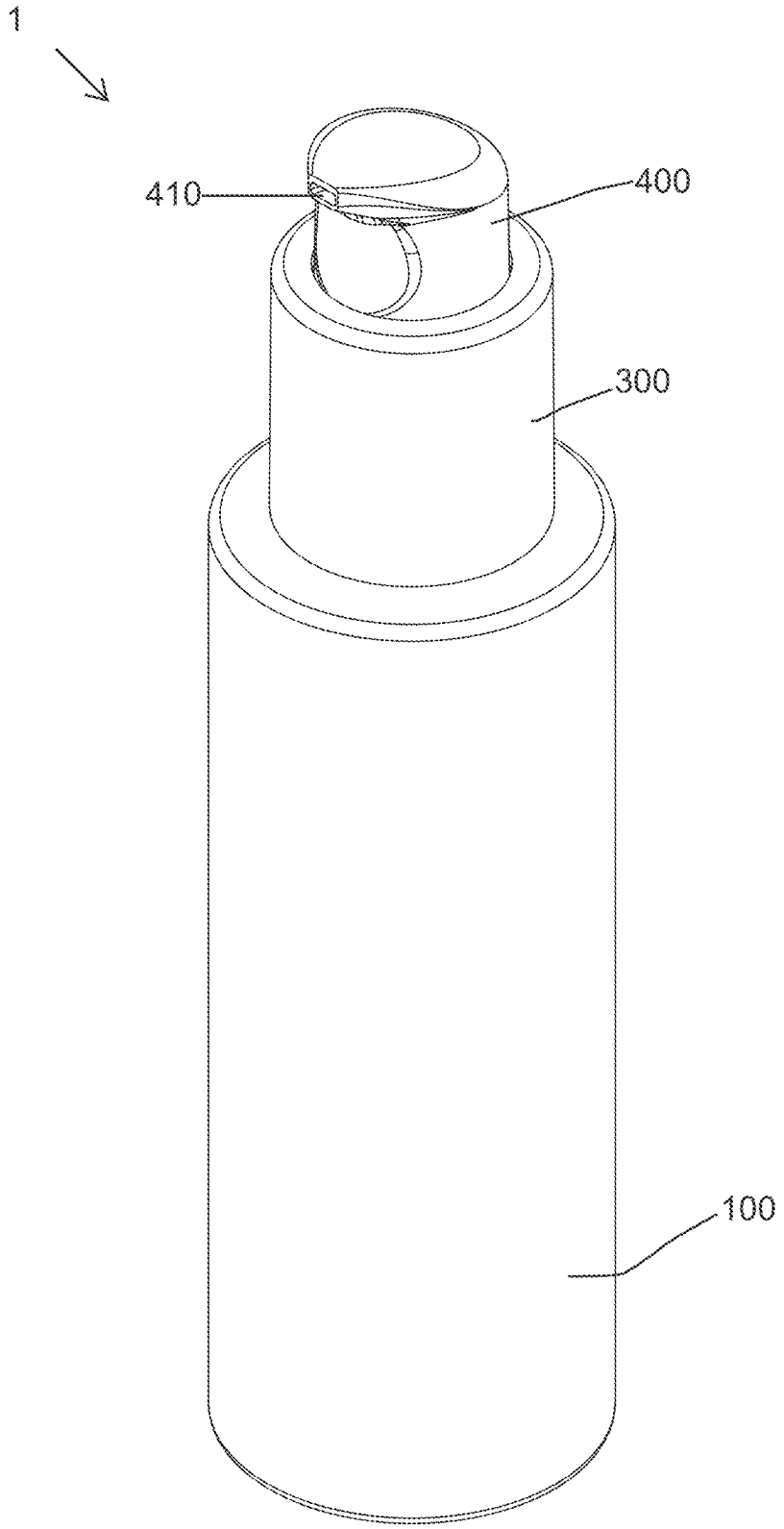
FIG. 1 illustrates a perspective view of a cosmetic package with an over cap thereof removed, according to a first embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

Hereinafter, exemplary embodiments of the present invention will be described in detail with reference to the accompanying drawings. The same reference numerals provided in the drawings indicate the same members.

Figure 2:
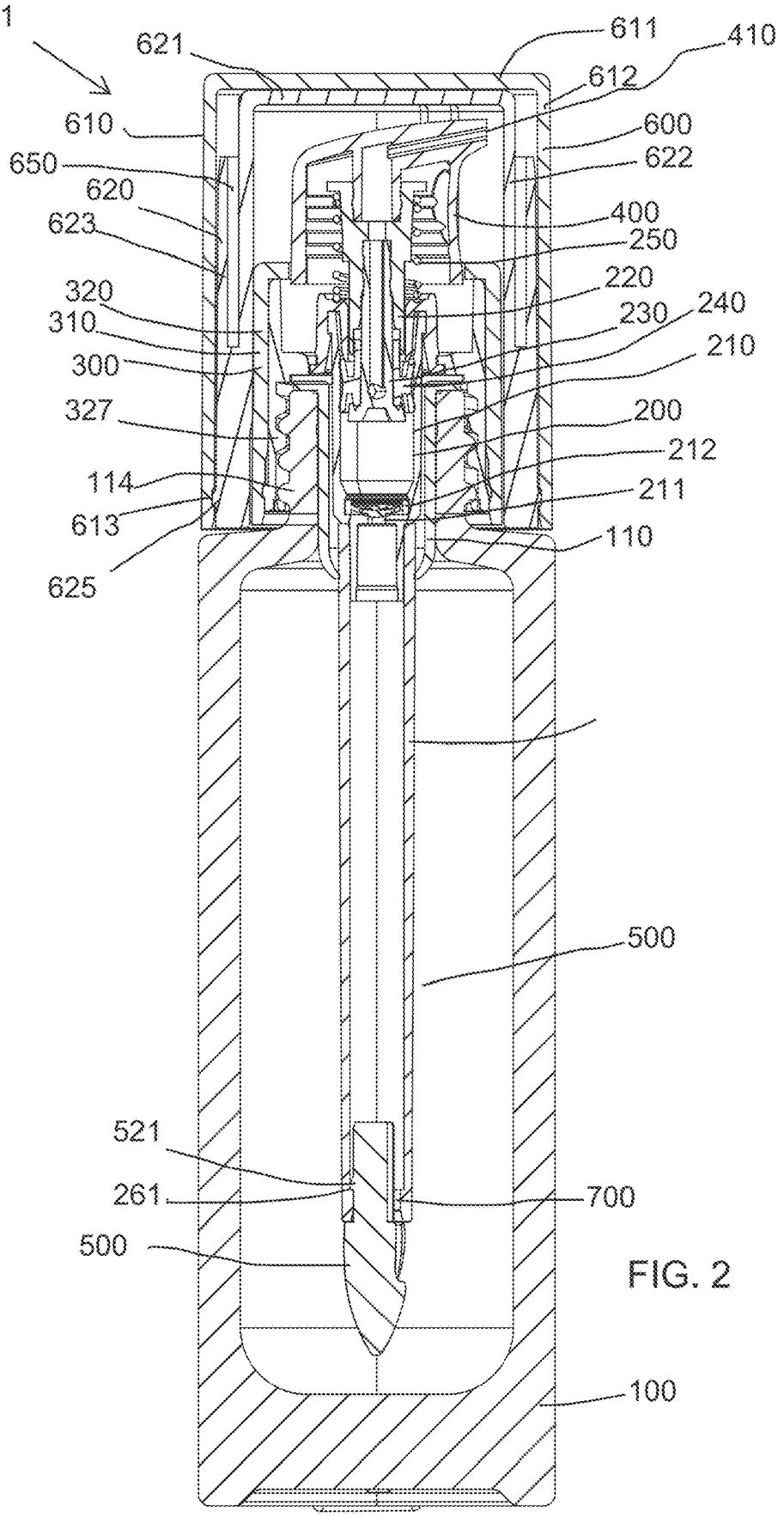
FIG. 2 illustrates a longitudinal cross-sectional view of the cosmetic package of FIG. 1 in a closed state, including the over cap thereof.

Referring to FIGS. 1 to 2, a cosmetic package 1 according to an exemplary first embodiment of the present disclosure includes a container body 100, a pumping member 200, a pump support body 300, a button and dispensing member 400, an applicator 500, and an over cap 600.

Referring to FIG. 2, the container body 100, holds liquid product like foundation or cream (not shown), and is designed with a wiper 110 attached into its neck portion 114. The wiper 110 is in close contact with an outer surface of a product suction tube 260 (explained later) and wipes any remaining product on the product suction tube 260, returning them to the container body 100 when the product suction tube is pulled out from the container body 100. The wiper 110 is hollow that allows the suction tube 260 to be easily inserted and withdrawn.

The pumping member 200, attached to the upper portion of the container body 100, is designed to discharge the product stored inside. The pumping member 200 includes a pump housing 210, which includes a product inflow hole 211 at its lower end and a check valve 212 that regulates the opening and closing of the inflow hole 211. A stem 220 is connected on one side to the button and dispensing member 400 (described later) and extends into the pump housing 210 on the other side, moving up and down with the motion of the button and dispensing member 400. Below the stem 220, a piston rod 230 is attached, and a piston ring 240 encases the lower portion of the piston rod 230, allowing it to move along the inner surface of the pump housing 210. Additionally, a spring 250 surrounds the stem 220, providing upward elastic force to enable the button and dispensing member 400 to operate repeatedly, facilitating efficient dispensing of the container body's product.

In the present disclosure, the product suction tube 260 is attached to a lower end of the pump housing 210, which is located at the bottom part of the pumping member 200. The product suction tube 260 serves as a product passageway, allowing the product stored in the container body 100 to flow into the pump housing 210 whenever the pumping member 200 is in operation.

The product suction tube 260 can be integrally formed at the lower end of the pump housing 210 or can be manufactured separately from the pump housing 210 and then coupled to the pump housing 210.

The pump support body 300 is connected to and supports the pumping member 200. The pump support body 300 includes a coupling part 310 with an internal screw thread 327, which allows it to be securely attached to or detached from the threaded neck portion 114 of the container body 100. This screw coupling ensures easy assembly and disassembly of the pump support body 300 with the container body 100.

Figure 3:
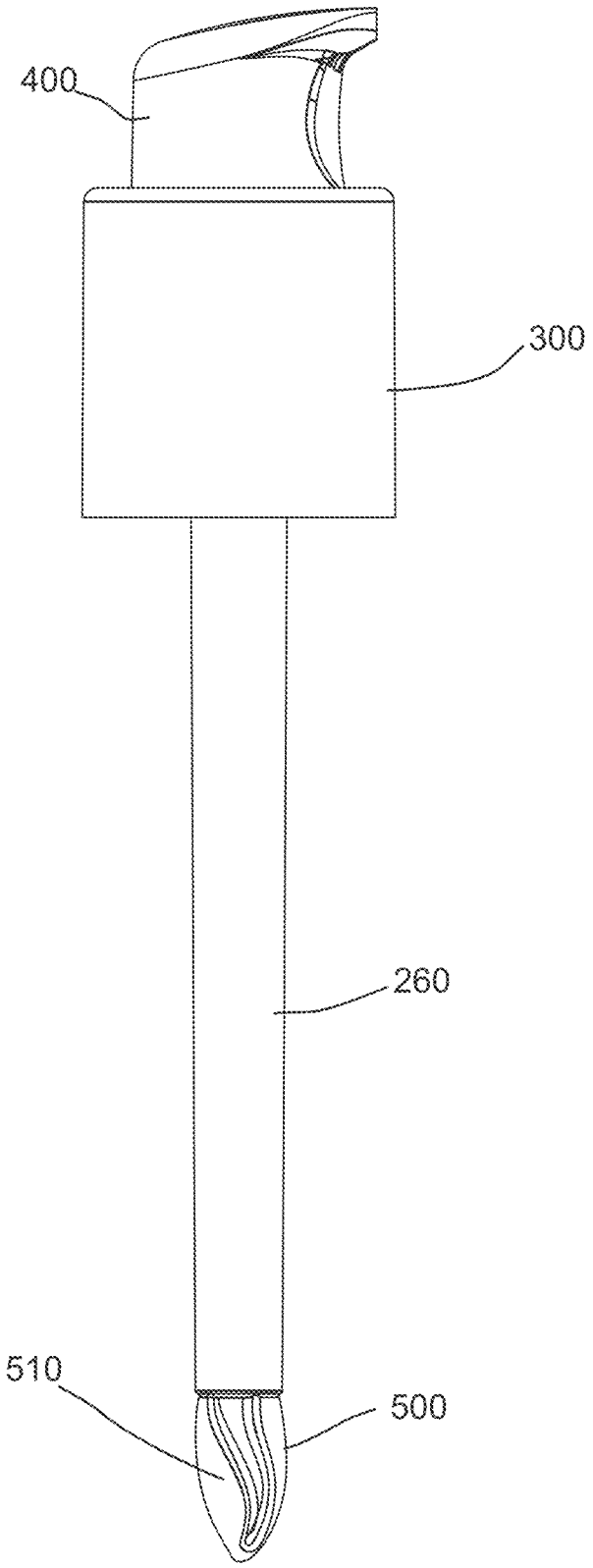
FIG. 3 illustrates a front view of the cosmetic package of FIG. 1 shown without the over cap and a container body thereof.
Figure 4:
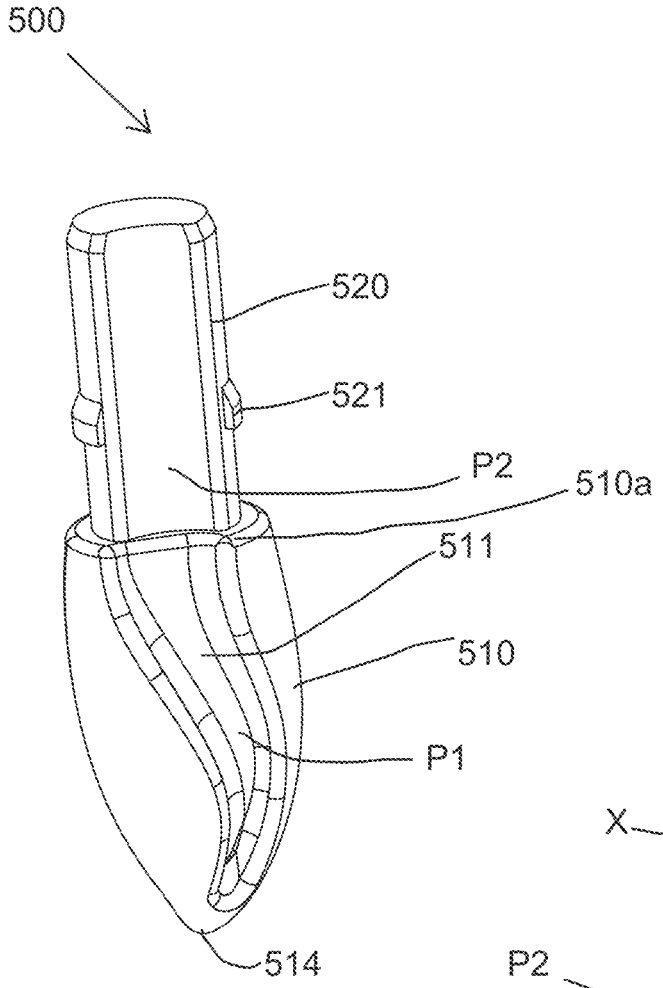
FIG. 4 illustrates an enlarged isometric view of an applicator of the cosmetic package of FIG. 3.
Figure 9:
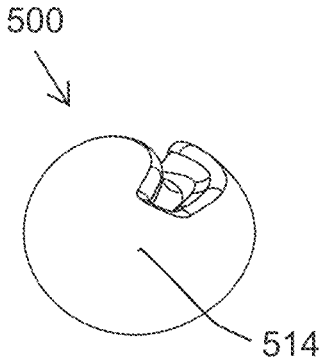
FIG. 9 illustrates a top side view of the applicator head of FIG. 4.

Referring to FIG. 3, the pump support body 300 can be unscrewed from the container body 100 and detached together with the pumping member 200. The cosmetic package 1, thus, allows the product stored in the container body 100 to be applied using an applicator 500, which is connected to the lower part of the product suction tube 260. This occurs when the product suction tube 260, forming the lower section of the pumping member 200, is withdrawn from the container body 100.

The button and dispensing member 400, attached to the upper part of the pumping member 200, transmits the pressure applied by the user to the pumping member 200, triggering its pumping action. The button and dispensing member 400 has a product discharge hole 410 on one side, allowing the product, moved upward by the pumping action, to be dispensed externally.

The applicator 500 is attached to the lower end of the product suction tube 260 and is designed to extract the product from the container body 100 for application to the user's skin. After the pump support body 300 is detached from the container body 100, the applicator 500 when immersed back into the product stored in the container body 100, the product is coated to the outer surface of the applicator 500 to be easily applied to the skin.

Referring to FIGS. 4-9, the applicator 500, extends along a central longitudinal axis X, includes an applying portion 510 at a distal portion thereof and a shank portion 520 at a proximal portion thereof. The shank portion 520 is received within hollow interior of the product suction tube 260. The shank portion 520 includes at least one connecting feature 521 for coupling to the product suction tube 260. The shank portion 520 includes a protrusion 521 as the connecting feature that snap fits into a groove 261 formed on an inner surface of the product suction tube 260, refer FIG. 2. The applicator 500 includes a feeder groove 511 that extends from adjacent a distal end of the applying portion 510 to a proximal end of the shank portion 520. The feeder groove 511 has a lower portion formed on an outer surface of the applying portion 510 and an upper portion formed on the shank portion 520. The feeder groove 511 forms an S-shaped product passageway P1 defined by the lower portion thereof on the outer surface of the applying portion 510 and a straight passage P2 defined by the upper portion of the feeder groove 511 on the shank portion 520. A width of the feeder groove 511 increases gradually from a distal end thereof towards the proximal end of the applying portion 510 and has a constant width from the proximal end of the applying portion 510 to the proximal end of the shank portion 520. In this particular embodiment, the feeder groove 511 has a maximum width at the proximal end 510*a* of the applying portion 510. When the applicator 500 is received at the distal end of the product suction tube 260, a feeder gap 700 is formed between an inner surface of the product suction tube 260 and an outer surface of the shank portion 520 where the feeder groove 511 exists. The feeder gap 700 defines a product delivery passageway 600. When the pumping member 200 performs pumping operation, the product stored in the container body 100 can be moved to a product discharge hole 410 through the feeder groove 511 and the product suction tube 260.

The feeder groove 511 facilitates the smooth transfer of the fluid product into the product suction tube 260 while also serving as a secondary reservoir for the applicator 500. The feeder groove 511 enhances the product loading capacity, ensuring that when the pump support body 300 is disengaged, the applying portion 510 of the applicator 500 retains sufficient fluid product for effective application, thereby eliminating the need for repeated dipping.

In the illustrated embodiment, the applying portion 510 of the applicator 500 has a rounded shape with a convex outer surface that narrows toward the distal end, terminating in a narrow-rounded tip 513. Specifically, the applying portion 510 has an asymmetric oval shape, having a flat proximal end. Additionally, includes the tip 514 located at its distal end 510*c*, which is positioned on the central longitudinal axis X of the applicator 500.

The applying portion 510 has four faces, namely, a front face 530, a back face 531, a left side face 532, and a right-side face 533. The back face 531 and the front face 530 are opposing faces, similarly, the left side face 532 and the right-side face 533 are opposing faces. The upper portion of the feeder groove 511 extends axially mainly on the front face 530 of the applying portion 510. A distal end 511*a* of the feeder groove 511 aligning with the central longitudinal axis X on the front face 530. Moving toward the proximal end 510*b* of the applying portion 510, the feeder groove 511 initially curves away from the central axis X toward the right-side face 533, then bends back across the central longitudinal axis X toward the left side face 532, and ultimately terminates at the proximal end 510*b* of the applying portion 510.

Figure 5:
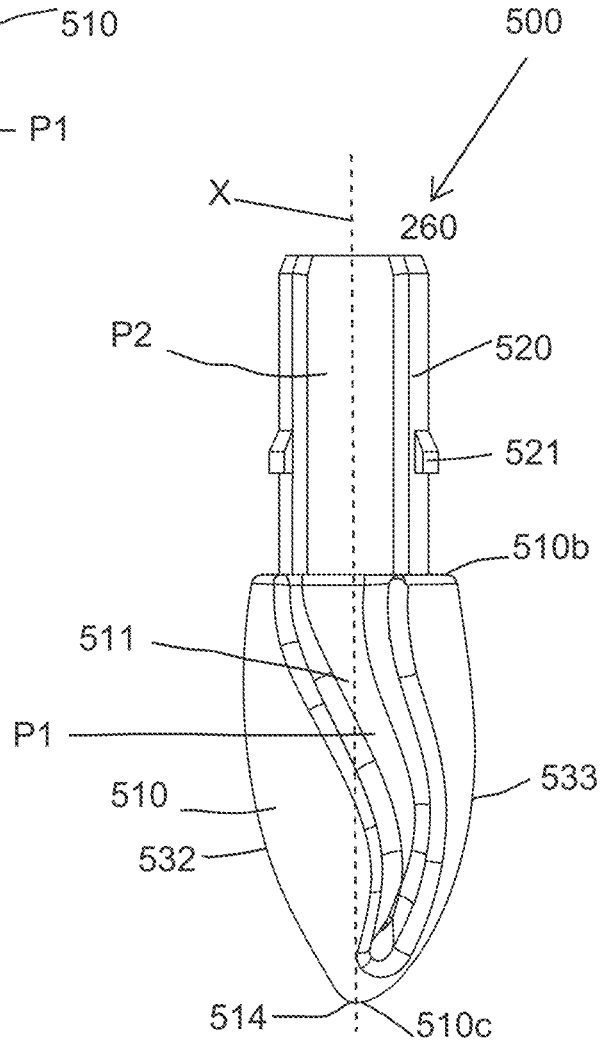
FIG. 5 illustrates a front view of the applicator of FIG. 4.
Figure 6:
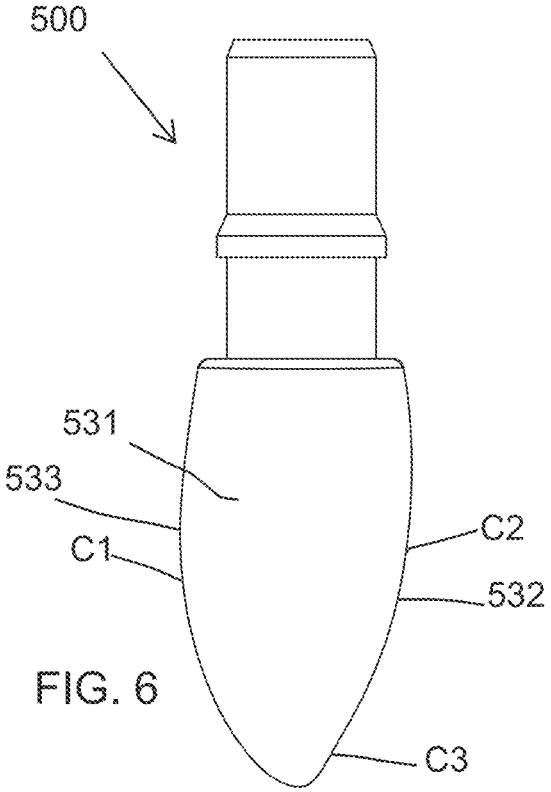
FIG. 6 illustrates a back view of the applicator head of FIG. 4.
Figure 7:
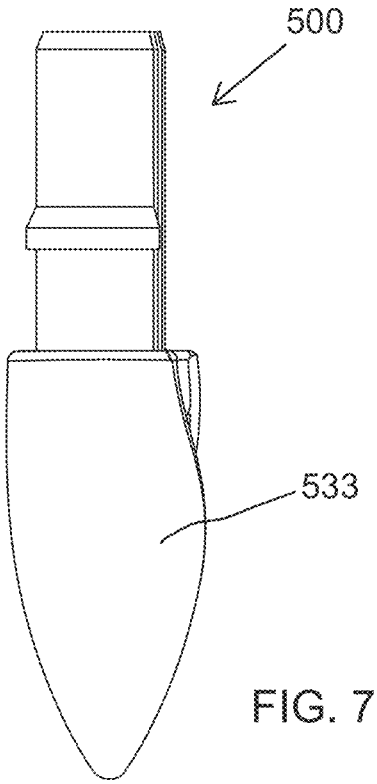
FIG. 7 illustrates a right-side view of the applicator head of FIG. 4.
Figure 8:
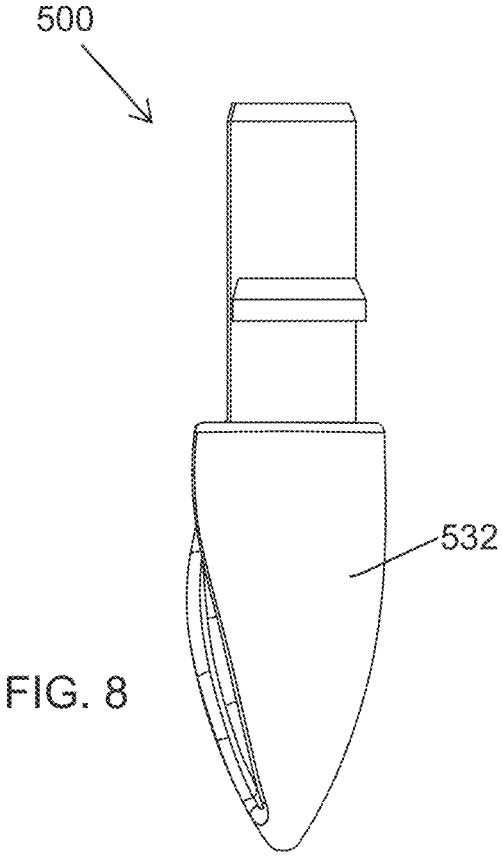
FIG. 8 illustrates a left side view of the applicator head of FIG. 4.

The left side face 532 and the right-side face 533 of the applying portion 510 are both predominantly convexly curved along the longitudinal axis X as well as along axes orthogonal to the longitudinal axis X. However, the convex profiles along the longitudinal axis X of the left side face 532 and the right-side face 533 are distinct from each other. As illustrated in FIG. 5, when viewed from the front face 530 or the back face 531 of the applicator 500, the right-side face 533 exhibits a continuous convex curve C1 extending from the proximal end 510*b* to the distal end 510*c* of the applying portion 510. In contrast, the left side face 532 includes a prominent convex curve C2 extending from the proximal end 510*b* of the applying portion 510 to a location near the distal portion of the applying portion 510, where it transitions into a minor concave curve C3 at the distal portion. The differing convex profiles along the longitudinal axis X of the left side face 532 and the right-side face 533 contribute to a mango-shaped appearance of the applying portion 510 when viewed from either the back face 531 or the front face 530 of the applicator 500.

Referring to FIGS. 2 and 11-14, the pump support body 300 comprises two components assembled together to operate as a single unit. These components include an outer sleeve 310 and an inner sleeve 320 enclosed by the outer sleeve 310. The outer sleeve 310 is characterized by a cylindrical sidewall 311 and an inner flange 312 extending radially inward and orthogonally from an upper peripheral edge of the cylindrical sidewall 311, thereby defining an upper opening 313. The cylindrical sidewall 311 of the outer sleeve 310 is open at its bottom end.

Figure 11:
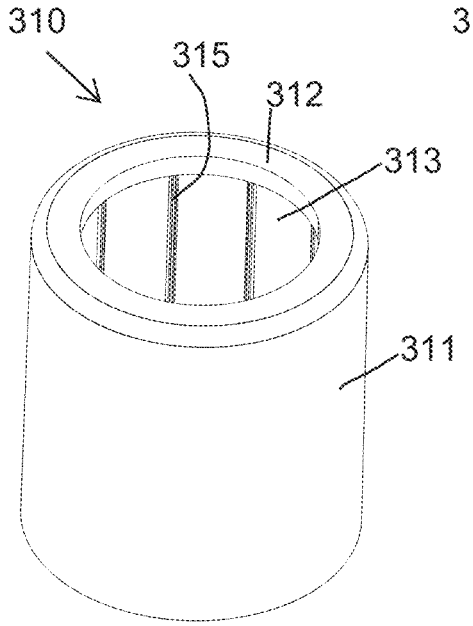
FIG. 11 illustrates an upper perspective view of an outer sleeve of a pump support body of the cosmetic package of FIG. 2.
Figure 12:
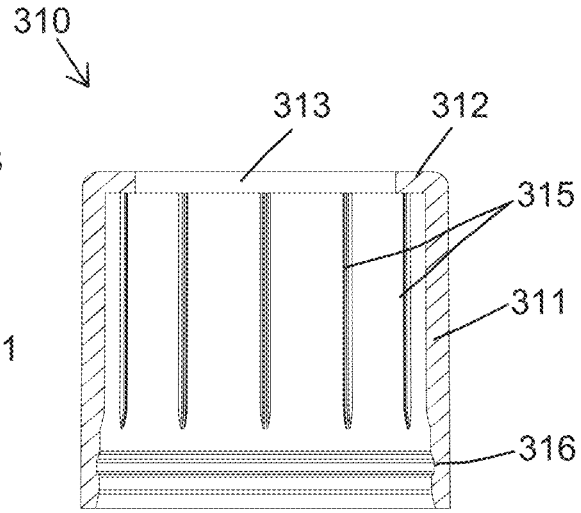
FIG. 12 illustrates a cross-sectional view of the outer sleeve FIG. 11.

Further, as seen in FIGS. 11 and 12, an inner surface of the cylindrical sidewall 311 of the outer sleeve 310 is provided with multiple axial projections 315 that are spaced uniformly around the inner circumference. Additionally, the inner surface of the cylindrical sidewall 311 includes an annular groove 316 located at a lower portion of the sidewall 311, positioned adjacent to the lower ends of the axial projections 315.

Figure 13:
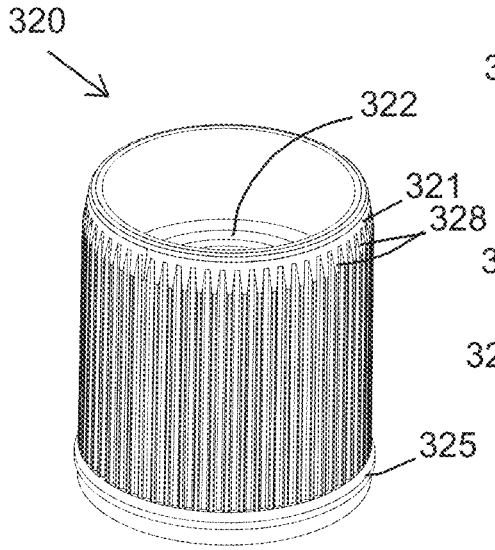
FIG. 13 illustrates an upper perspective view of an inner sleeve of a pump support body of the cosmetic package of FIG. 2.
Figure 14:
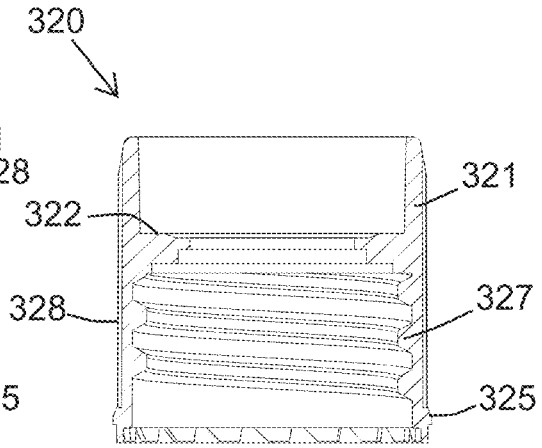
FIG. 14 illustrates a cross-sectional view of the inner sleeve FIG. 13.

Referring to FIGS. 13 and 14, the inner sleeve 320 has a cylindrical sidewall 321 with open top and bottom ends. An inner flange 322 is formed extending radially inward and perpendicularly from the inner surface of the cylindrical sidewall 321, defining a central opening 323 within the hollow interior of the cylindrical sidewall 321. Positioned below the inner flange 322, threads 327 are provided on the inner surface of the cylindrical sidewall 321. These threads 327 are designed to engage with corresponding threads on the neck portion of the container body 100, thereby securing the pump support body 300 to the container body 100. Additionally, a protrusion 325 is formed on the outer surface of the cylindrical sidewall 321 of the inner cap 320. This protrusion 325 is configured to be received within the annular groove 316 formed on the lower portion of the cylindrical sidewall 311 of the outer sleeve 310. This arrangement ensures that the inner cap 320 and the outer sleeve 310 are securely coupled, thereby forming the unified pump support body 300.

Furthermore, the inner sleeve 320 comprises a plurality of axial ribs 328 uniformly spaced circumferentially on the outer surface of its cylindrical sidewall 321 thereof. The gaps between adjacent axial ribs 328 of the plurality are axial ribs 328 configured to receive the multiple axial projections 315 located on the inner surface of the outer sleeve 310. This interlocking arrangement ensures that the inner sleeve 320 and the outer sleeve 310 are rotationally fixed relative to each other, preventing any unintended relative movement.

As seen in FIG. 2, the over cap 600 is designed to be detachably coupled, enclosing the button and dispensing member 400 and the pump support body 300. The over cap 600 prevents accidental operation of the button and dispensing member 400 while also blocking foreign substances from entering the product discharge hole 410. Once the over cap 600 is removed from the pump support body 300, the button and dispensing member 400 can be operated to dispense the product through the product discharge hole 410.

Figure 15:
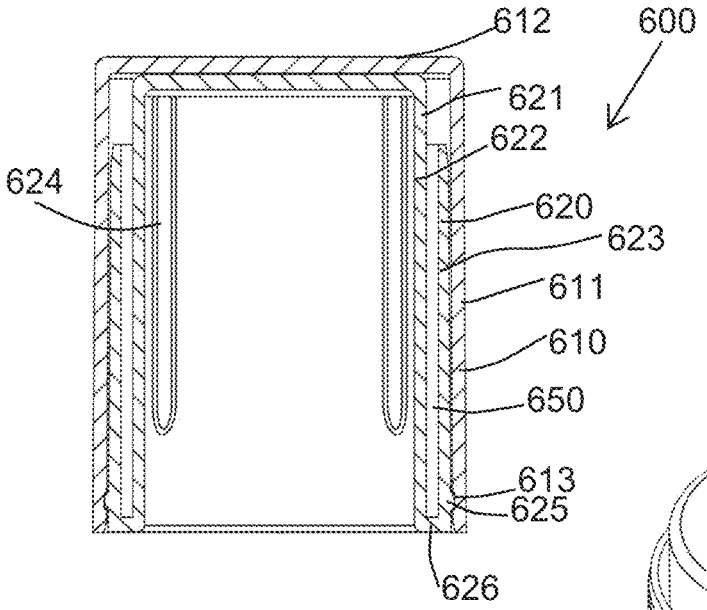
FIG. 15 illustrates a cross-sectional view of the over cap of the cosmetic package of FIG. 2.

As seen in FIGS. 2 and 15, the over cap 600 comprises two interconnected parts, an outer cap 610 and an inner cap 620, which together function as a single unit. The outer cap 610 has a cylindrical structure with a top wall 611 and a sidewall 612 extending downwardly from a peripheral edge of the top wall 611.

Figure 16:
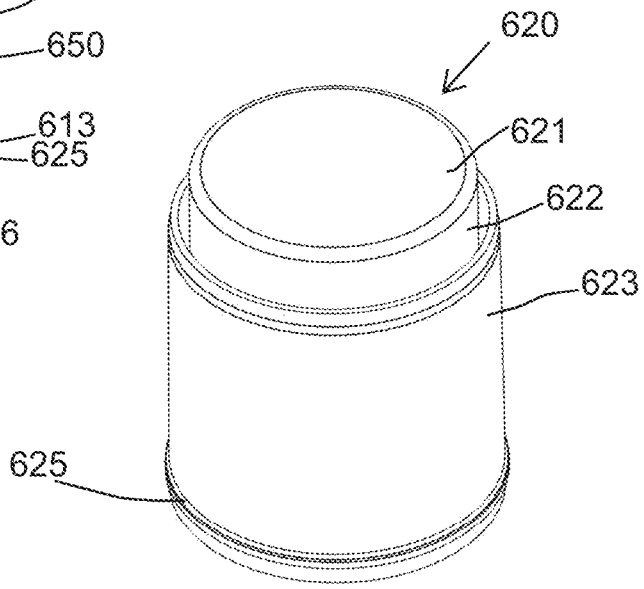
FIG. 16 illustrates an upper perspective view of an inner cap of the over cap of FIG. 15.
Figure 17:
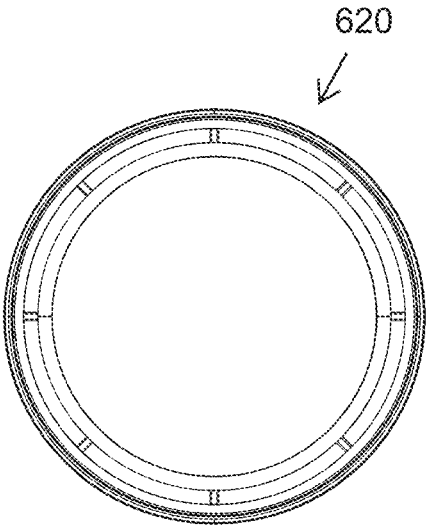
FIG. 17 illustrates a top view of the inner cap of FIG. 16.
Figure 18:
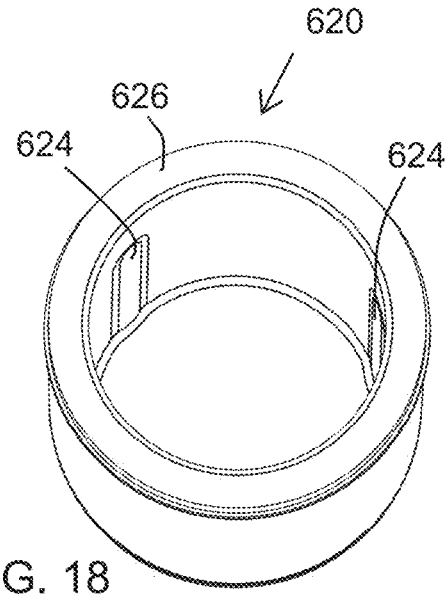
FIG. 18 illustrates a bottom perspective view of the inner cap of FIG. 16.

Referring to FIGS. 16 to 18, the inner cap 620 has a double-sidewall design and includes a top wall 621 and a first cylindrical sidewall 622 that extends downwardly from a peripheral edge of the top wall 621. The inner cap 620 includes a secondary sidewall 623 that is radially outwardly from the first cylindrical sidewall 622 and connected to each other at their lower edges through an annular bottom wall 626. A circumferential gap 650 exists between the secondary sidewall 623 and the first cylindrical sidewall 622. The circumferential gap 650 provides flexibility to the structure of the inner cap 620.

Additionally, referring to FIGS. 18 and 15, the inner surface of the first cylindrical sidewall 622 includes at least three uniformly spaced axial protrusions 624, (only two axial protrusions 624 are visible in the drawings) which extend from the lower edge of the top wall 621 along the inner surface of the first cylindrical sidewall 622. When the over cap 600 is positioned over the pump support body 300, the at least three uniformly spaced axial protrusions 624 ensure a secure and tight engagement between the over cap 600 and the pump support body 300. This configuration of the over cap 600 contributes to a clean and aesthetically pleasing appearance of the cosmetic package 1 when the over cap 600 is removed, as no visible coupling features are present on the pump support body 300, the container body 100, or the button and dispensing member 400.

As seen in FIGS. 2 and 15, the sidewall 612 of the outer cap 610 includes a groove 613 on its inner surface. An outer surface of the lower portion 622*b* of the first cylindrical sidewall 622 has a protrusion 625 that fits into the groove 613 of the outer cap 610, thereby securely coupling the outer cap 610 and the inner cap 620 together.

When the over cap 600 is removed from the pump support body 300, pressing the button and dispensing member 400 activates the pumping member 200 to discharge the product for use. The product stored in the container body 100 are drawn into the product suction tube 260 through the feeder gap 700, that exists between the inner surface of the suction pipe 260 and an outer surface of the shank portion 520, and transported upward. Once the product reaches the pump housing 210 via the product suction tube 260, they pass through the piston rod 230 and the stem 220 before being dispensed through the product discharge hole 410, making them ready for application to the skin.

To apply the product using the applicator 500, the pump support body 300 is unscrewed from the container body 100, allowing the pump support body 300 to be detached from the container body 100.

When the pump support body 300 is detached from the container body 100, the pumping member 200, which is attached to the pump support body 300, will also be removed. Consequently, the product suction tube 260, the pumping member 200, and the applicator 500 will be withdrawn from the container body 100. This allows the product on the outer surface of the applicator 500, which is attached to the lower end of the product suction tube 260, to be applied directly onto the skin. An additional quantity of the product is held within the feeder groove 511, eliminating the need for repeated dipping of the applicator 500 into the container body 100 and supplying a sufficient amount of product for effective application.

Essentially, the present invention provides the option to either dispense the product through the button and dispensing member 400 using the pumping mechanism or apply the product directly onto the user's skin with the applicator 500, without the need for pumping. This flexibility caters to user preferences and enhances overall convenience.

Figure 19:
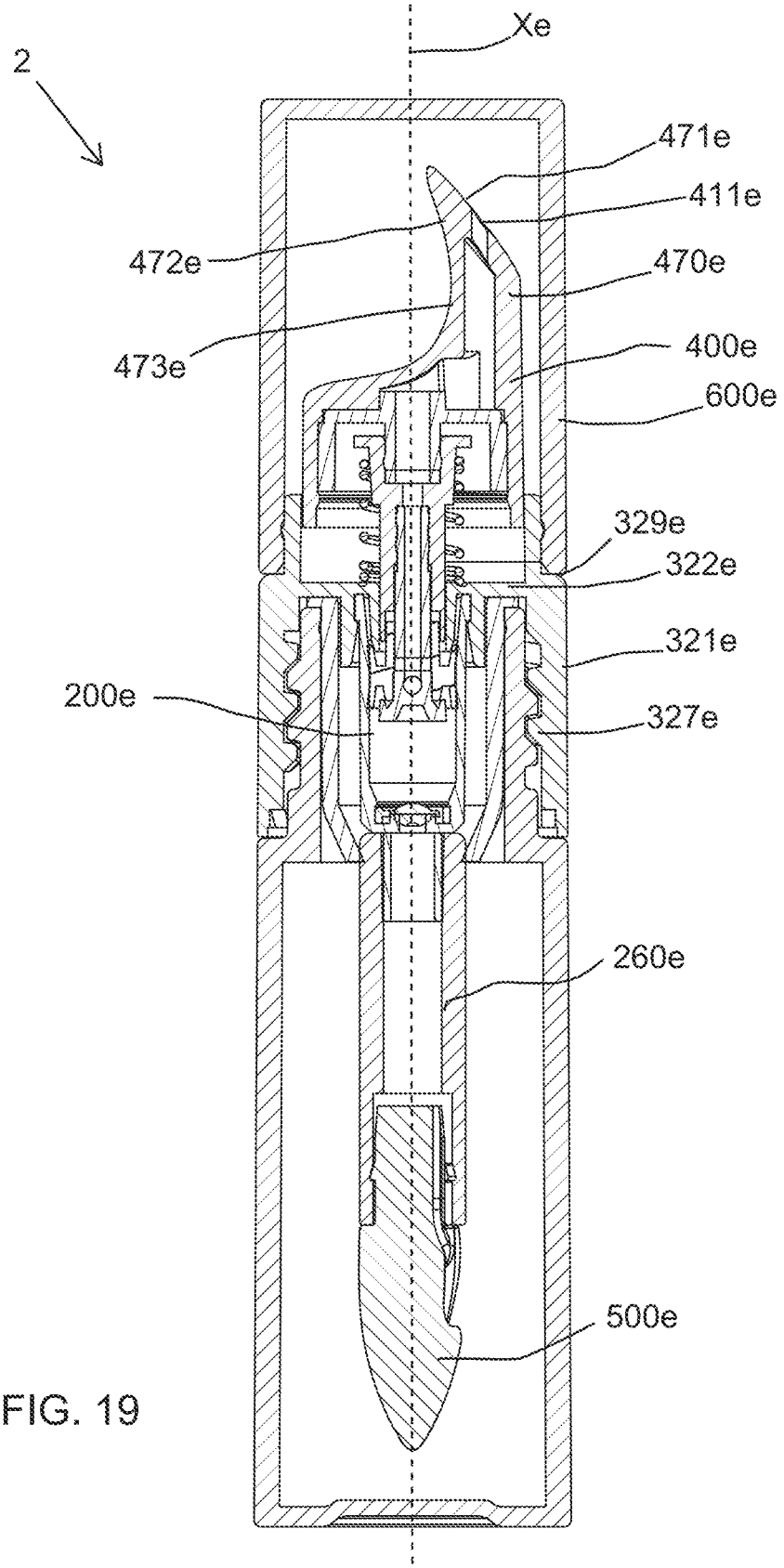
FIG. 19 illustrates a longitudinal cross-sectional view of a cosmetic package according to a second embodiment of the present disclosure.
Figure 20:
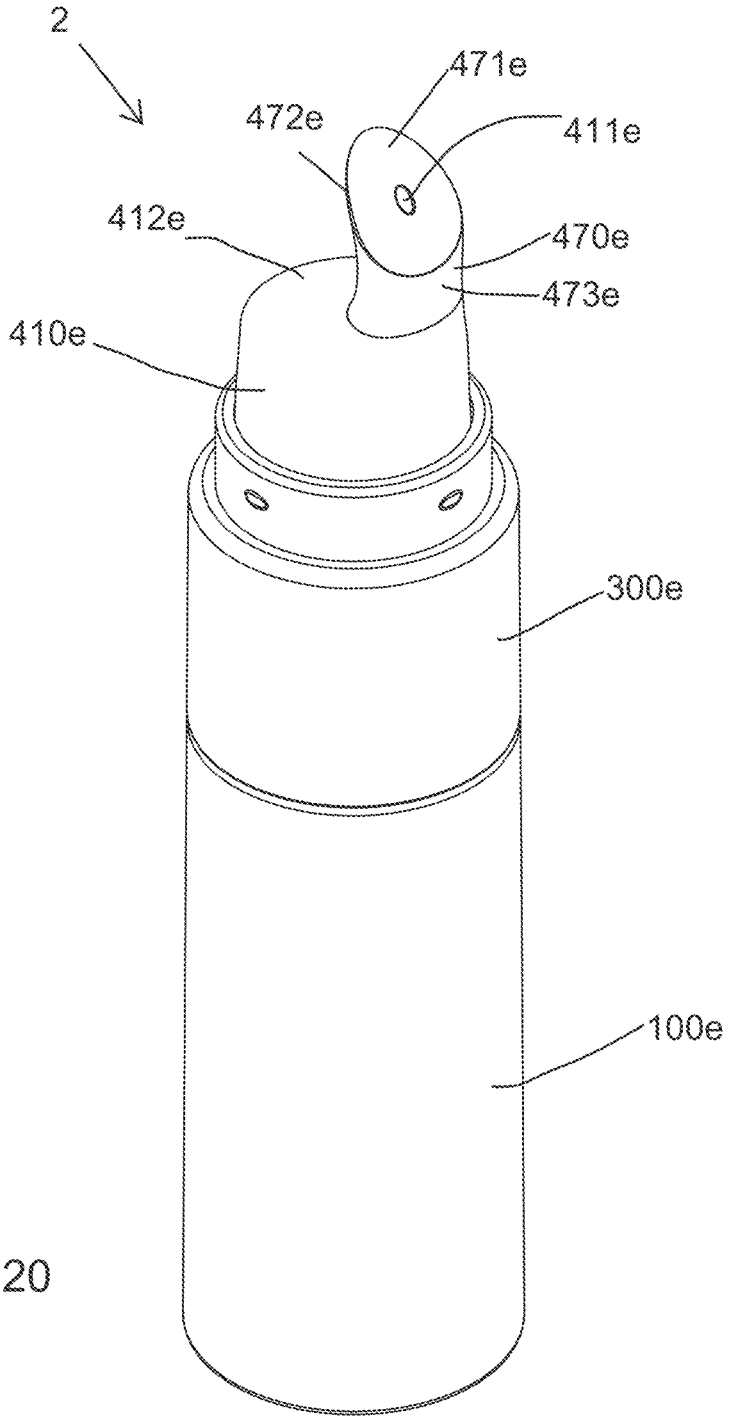
FIG. 20 illustrates a perspective view of the cosmetic package of FIG. 19, shown without an over cap thereof.

FIGS. 19 to 20 show a cosmetic package 2 according to a second embodiment of the present disclosure. Like the first embodiment, the cosmetic package of the second embodiment too includes a container body 100*e*, a pumping member 200*e*, a pump support body 300*e*, the product suction tube 260*e*, a button and dispensing member 400*e*, an applicator 500*e*, and an over cap 600*e*. However, in the second embodiment, the structures of the button and dispensing member 400*e*, the pump support body 300*e*, the over cap 600*e* differs slightly from the button and dispensing member 400, the pump support body 300, the over cap 600 of the first embodiment.

As illustrated in FIGS. 19 and 20, the button and dispensing member 400*e* of the second embodiment includes an integrated applicator 470*e*. The integrated applicator 470*e* includes an applicator face 471*e* through which the product is dispensed via a product discharge hole 411*e*. The applicator face 471*e* has a larger surface area which enables direct application of the product onto the skin. This eliminates the need to collect the liquid for indirect application by hand, thereby reducing the risk of contamination and ensuring a more hygienic application process. The integrated applicator 470*e* is positioned offset from the central longitudinal axis Xe of both the cosmetic package 2 and the button and dispensing member 400*e*. The design of the integrated applicator 470*e* comprises a neck portion 473*e* that transitions smoothly into an applicator head 472*e*, which end in the applicator face 471*e* at its upper end. The applicator face 471*e* is shaped as an oblique, drop-shaped surface, which offers a broad yet precise area for applying the product. This offset configuration of the applicator 470*e* ensures enhanced ergonomics, allowing for better control and precision during application, particularly in hard-to-reach areas or for achieving defined coverage. The button and dispensing member 400*e* comprises a lower cylindrical button portion 410*e*, which includes a horizontal pressing surface 412*e* positioned on its upper section, located adjacent to the applicator 470*e*. The applicator head 471*e* comprising the applicator face 471*e* is connected to the lower cylindrical portion by the neck portion 473*e* of the applicator 47*e*.

In contrast to the first embodiment, the over cap 600*e* is attached to the outer surface of the upper portion of the pump support body 300*e*, leaving parts of the pump support body 300*e* exposed in the closed and covered state of the cosmetic package 2, unlike the full coverage seen in the first embodiment. Additionally, the outer surface of the upper portion of the pump support body 300*e* includes a series of bumps designed to engage with an inner groove 612*e* located on the inner surface of the sidewall 612*e* of the over cap 600*e*, thereby enabling a removable snap-fit connection between the over cap 600*e* and the pump support body 300*e*.

In addition, the over cap 600*e* of the second embodiment is a single-piece component, unlike the first embodiment, which has a two-piece configuration comprising an inner cap and an outer cap. The over cap 600*e* consists of a cylindrical structure with a top wall 611*e* and a sidewall 612*e* extending downwardly from the peripheral edge of the top wall 611*e*.

In the second embodiment, the pump support body 300*e* is a single-piece structure, differing from the two-piece configuration of an inner sleeve and an outer sleeve featured in the first embodiment. The pump support body 300*e* comprises a cylindrical sidewall 321*e* with open top and bottom ends. An inner flange 322*e* projects radially inward and perpendicularly from the inner surface of the cylindrical sidewall 321*e*, forming a central opening within its hollow interior. Below the inner flange 322*e*, the inner surface of the cylindrical sidewall 321*e* is equipped with threads 327*e*, which are designed to engage with complementary threads on the neck of the container body 100*e*, ensuring a secure and detachable connection. Additionally, the upper portion of the sidewall 321*e*, above the inner flange 322*e*, steps inward, creating a horizontal step 329*e* where the bottom edge of the over cap 600*e* rests, aligning seamlessly with the outer surface of the lower portion of the pump support body 300*e* and ensuring a flush fit with the pump support body 300*e*.

To dispense the product using button and dispensing member 400*e*, the user first needs to remove the over cap 600*e*, thereby exposing the button and dispensing member 400*e*. Dispensing is initiated by pressing the horizontal pressing surface 412*e* located on the upper part of the button and dispensing member 400*e*. Upon pressing, the button and dispensing member 400*e* moves downward, activating the pumping member 200*e*, which causes the cosmetic product to be dispensed directly onto the applicator face 471*e* of the applicator 470*e*. The applicator face 471*e* is then used to apply the product directly onto the skin, eliminating the need to use hands or any separate tool, thereby avoiding contamination or waste.

Figure 21:
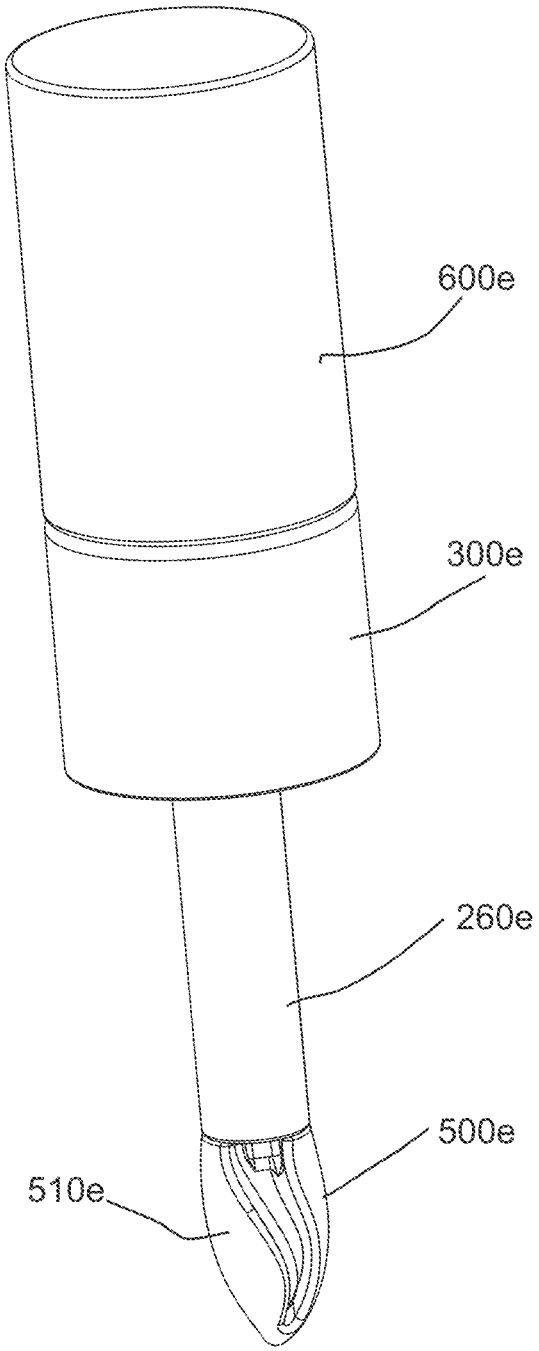
FIG. 21 illustrates a perspective view of the cosmetic package of FIG. 19, shown without a container body thereof.

If the user intends to utilize the applicator 500*e* for dispensing and application, the removal of the over cap 600*e* is not necessary. Instead, the user must unthread the pump support body 260*e* from the container body 100*e*. Upon detachment of the pump support body 260*e*, the suction tube and the applicator 500*e* are simultaneously removed and exposed, making them ready for product application. During this process, the button and dispensing member 400*e* remains securely attached to the upper portion of the pump support body 260*e* and is covered by the over cap 600*e*, thereby ensuring its cleanliness and protection, as illustrated in FIG. 21.

Figure 10:
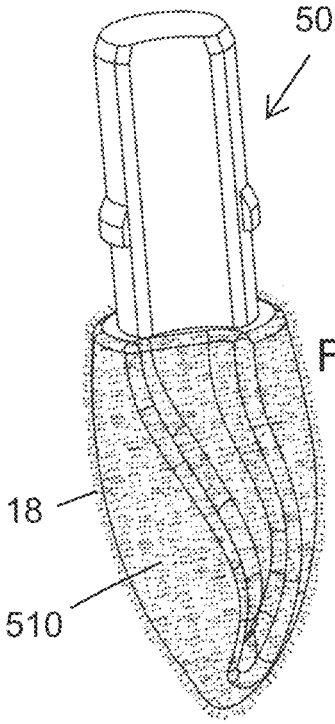
FIG. 10 illustrates the applicator of FIG. 4, with an outer surface of an applying portion thereof flocked with fibers.

According to an aspect of the present disclosure, the applying portion 510, 510*e* of the applicator 500, 500*e* may be flocked with fibers 18, as seen in the FIG. 10.

According to another aspect of the disclosure, the fibers 18 may include at least one material selected from polyamides, polyacrylics, polyesters, cottons, and cellulose or any other material know in the art for providing a soft feel. For example, the fibers may include at least one material selected from Nylon®, viscose, and rayon. The fibers may be selected from fibers having any colors.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A cosmetic package for dual dispensing of a fluid product, the cosmetic package comprising:

a container body configured to store the fluid product;

a pumping member including a pump housing with a product inflow hole, a check valve, a stem, a piston rod, a piston ring, and a spring;

a product suction tube connected to a lower end of the pump housing for transferring the fluid product from the container body to the pumping member;

a pump support body detachably attached to the container body for supporting the pumping member;

an applicator attached to a lower end of the product suction tube;

a button and dispensing member connected to an upper end of the pumping member, enabling the fluid product discharge;

an over cap removably secured to the container body to enclose the button and dispensing member and the pump support body;

wherein the button and dispensing member includes a product discharge hole for discharging the fluid product;

wherein the applicator includes an applying portion at a distal portion thereof and a shank portion at a proximal portion thereof;

wherein the shank portion includes a connecting feature on an outer surface thereof for coupling to the product suction tube;

wherein the applicator includes a feeder groove that extends from adjacent distal end of the applying portion to a proximal end of the shank portion;

wherein the applying portion includes four faces, namely, a front face, a back face, a left side face, and a right-side face;

wherein the feeder groove extends axially in a curved manner along an outer surface of the front face of the applying portion and rectilinearly along the shank portion;

wherein when seen from the distal end to the proximal end of the applying portion, a distal end of the feeder groove aligns with a central longitudinal axis on the front face, curves away from the central longitudinal axis toward the right-side face, bends back across the central longitudinal axis toward the left side face, and reaches the proximal end of the applying portion;

wherein a width of the feeder groove increases gradually from a distal end thereof towards the proximal end of the applying portion and then remains constant from the proximal end of the applying portion to the proximal end of the shank portion;

wherein a feeder gap is formed between an inner surface of the product suction tube and an outer surface of the shank portion where the feeder groove is located; and wherein when the button and dispensing member is actuated, the pumping member performs pumping operation, moving the fluid product stored in the container body to move through the feeder gap and into the product suction tube, dispensing the fluid product out through the product discharge hole; and wherein the fluid product can be discharged through the applicator and applied onto a skin when the pump support body is separated from the container body;

wherein the applying portion has an asymmetric oval shape with a flat proximal end; wherein when viewed from the front face of the applicator, the right-side face has a continuous convex curve extending from the proximal end to the distal end of the applying portion, and the left side face includes a prominent convex curve extending from the proximal end of the applying portion to a location near the distal portion of the applying portion, transitioning into a minor concave curve at the distal end.

2. The cosmetic package according to claim 1, wherein the feeder groove has a maximum width at the proximal end of the applying portion.

3. The cosmetic package according to claim 1, wherein the pumping member includes a pump housing, which includes the product inflow hole at its lower end, wherein the check valve regulates opening and closing of the product inflow hole; wherein the stem is connected on one side to the button and dispensing member and extends into the pump housing on the other side; wherein below the stem, the piston rod is attached, and a piston ring encases a lower portion of the piston rod, and wherein the spring surrounds the stem.

4. The cosmetic package according to claim 1, wherein the pump support body comprises an outer sleeve and an inner sleeve enclosed by the outer sleeve; wherein the outer sleeve is characterized by a cylindrical sidewall and an inner flange extending radially inward and orthogonally from an upper peripheral edge of the cylindrical sidewall, thereby defining an upper opening; wherein the inner sleeve includes a cylindrical sidewall with open top and bottom ends, and an inner flange extending radially inward and perpendicularly from an inner surface of the cylindrical sidewall; and wherein threads are provided on the inner surface of the cylindrical sidewall of the inner sleeve.

5. The cosmetic package according to claim 4, wherein the inner surface of the cylindrical sidewall of the outer sleeve is provided with multiple axial projections that are spaced uniformly around an inner circumference; and wherein the inner sleeve comprises a plurality of axial ribs uniformly spaced circumferentially on an outer surface of its cylindrical sidewall thereof; and wherein gaps between adjacent axial ribs of the plurality of axial ribs are configured to receive the multiple axial projections located on the inner surface of the outer sleeve.

6. The cosmetic package according to claim 4, wherein a protrusion is formed on the outer surface of the cylindrical sidewall of the inner cap and wherein the protrusion is configured to be received within an annular groove formed on a lower portion of the cylindrical sidewall of the outer sleeve.

7. The cosmetic package according to claim 1, wherein the over cap comprises two interconnected parts, an outer cap and an inner cap, which together function as a single unit; wherein the outer cap has a cylindrical structure with a top wall and a sidewall extending downwardly from a peripheral edge of the top wall; wherein the inner cap includes a top wall, a first cylindrical sidewall that extends downwardly from a peripheral edge of the top wall, a secondary sidewall that is radially outwardly from the first cylindrical sidewall, and an annular bottom wall that connects lower edges of the first cylindrical sidewall and the secondary sidewall; and wherein a circumferential gap exists between the secondary sidewall and the first cylindrical sidewall.

8. The cosmetic package according to claim 1, wherein the inner surface of the first cylindrical sidewall of the inner cap includes at least three uniformly spaced axial protrusions; wherein when the over cap is positioned over the pump support body, the at least three uniformly spaced axial protrusions ensure a secure and tight engagement between the over cap and the pump support body.

9. The cosmetic package according to claim 1, wherein the outer surface of the applying portion is flocked with fibers.

10. A cosmetic package for dual dispensing of a fluid product, the cosmetic package comprising:

a container body configured to store the fluid product;

a pumping member;

a product suction tube connected to a lower end of the pumping member for transferring the fluid product from the container body to the pumping member;

a pump support body attached to the container body for supporting the pumping member;

an applicator attached to a lower end of the product suction tube;

a button and dispensing member connected to an upper end of the pumping member, enabling the fluid product discharge;

an over cap removably secured to the pump support body to enclose the button and dispensing member and the pump support body;

wherein the button and dispensing member includes a product discharge hole for discharging the fluid product;

wherein the applicator includes an applying portion at a distal portion thereof and a shank portion at a proximal portion thereof;

wherein the applying portion of the applicator is configured to apply the fluid product directly to a skin of a user;

wherein the shank portion includes a connecting feature on an outer surface thereof for coupling to the product suction tube;

wherein the applicator includes a feeder groove that extends from adjacent distal end of the applying portion to a proximal end of the shank portion;

wherein a feeder gap is formed between an inner surface of the product suction tube and an outer surface of the shank portion where the feeder groove is located; and wherein when the button and dispensing member is actuated, the pumping member performs pumping operation, moving the fluid product stored in the container body to move through the feeder gap and into the product suction tube, dispensing the fluid product out through the product discharge hole;

wherein the applying portion includes four faces, namely, a front face, a back face, a left side face, and a right-side face; wherein the applying portion has an asymmetric oval shape with a flat proximal end; wherein when viewed from the front face of the applicator, the right-side face has a continuous convex curve extending from the proximal end to the distal end of the applying portion; wherein the left side face includes a prominent convex curve extending from the proximal end of the applying portion to a location near the distal portion of the applying portion, transitioning into a minor concave curve at the distal end; and wherein a width of the feeder groove increases gradually from a distal end thereof towards the proximal end of the applying portion.

11. A cosmetic package for dual dispensing of a fluid product, the cosmetic package comprising:

a container body configured to store the fluid product;

a pumping member;

a product suction tube connected to a lower end of the pumping member for transferring the fluid product from the container body to the pumping member;

a pump support body attached to the container body for supporting the pumping member;

an applicator attached to a lower end of the product suction tube;

a button and dispensing member connected to an upper end of the pumping member, enabling the fluid product discharge;

an over cap removably secured to the pump support body to enclose the button and dispensing member and the pump support body;

wherein the button and dispensing member includes a product discharge hole for discharging the fluid product;

wherein the applicator includes an applying portion at a distal portion thereof and a shank portion at a proximal portion thereof;

wherein the applying portion of the applicator is configured to apply the fluid product directly to a skin of a user;

wherein the shank portion includes a connecting feature on an outer surface thereof for coupling to the product suction tube;

wherein the button and dispensing member includes an integrated applicator;

wherein the integrated applicator includes an applicator face through which the fluid product is dispensed via the product discharge hole;

wherein the button and dispensing member comprises a lower cylindrical button portion with a horizontal pressing surface on an upper surface thereof and the integrated applicator extending upwardly therefrom; and wherein the integrated applicator comprises a neck portion extending upwardly from the lower cylindrical button portion and transiting into an applicator head, wherein the applicator head defining the applicator face at an upper surface thereof;

wherein when the button and dispensing member is actuated, the pumping member performs pumping operation, and dispensing the fluid product out through the product discharge hole located on the integrated applicator;

wherein the integrated applicator includes a feeder groove that extends from adjacent distal end of the applying portion to a proximal end of the shank portion; wherein a feeder gap is formed between an inner surface of the product suction tube and an outer surface of the shank portion where the feeder groove is located; and wherein when the button and dispensing member is actuated, the pumping member performs pumping operation, moving the fluid product stored in the container body to move through the feeder gap and into the product suction tube, dispensing the fluid product out through the product discharge hole.

12. The cosmetic package according to claim 11, wherein the applicator face of the integrated applicator is shaped as an oblique, drop-shaped surface.

13. The cosmetic package according to claim 11, wherein the outer cap is removably attached to the outer surface of an upper portion of the pump support body, leaving parts of the pump support body exposed in a closed and covered state of the cosmetic package.

14. The cosmetic package according to claim 11, wherein the integrated applicator is positioned offset from a central longitudinal axis of both the cosmetic package and the button and dispensing member.

* * * * *